United States Patent [19]

Heyn et al.

[11] Patent Number: 4,709,419

[45] Date of Patent: Dec. 1, 1987

[54] COVER GARMENT WITH INNER GARMENT ACCESS OPTION

[75] Inventors: Lynn E. Heyn, Woodstock; Malcolm L. Johnson, Atlanta; Danial O. Fischer, Waleska, all of Ga.

[73] Assignee: Kimberly-Clarke Corporation, Neenah, Wis.

[21] Appl. No.: 644,297

[22] Filed: Aug. 27, 1984

[51] Int. Cl.[4] ..... A41D 27/12; A41D 27/20

[52] U.S. Cl. ..... 2/46; 3/247

[58] Field of Search ..... 2/46, 114, 247, 231, 2/88, 84

[56] References Cited

U.S. PATENT DOCUMENTS

| | | | |
|---|---|---|---|
| 2,029,564 | 2/1936 | Gowdy | 2/88 |
| 2,372,110 | 3/1945 | Noone | 2/84 |
| 3,014,218 | 12/1961 | Smith | 2/84 |
| 4,313,229 | 2/1982 | Villafane | 2/84 |

FOREIGN PATENT DOCUMENTS

| | | | |
|---|---|---|---|
| 484510 | 5/1938 | United Kingdom | 2/85 |

*Primary Examiner*—Doris L. Troutman

*Attorney, Agent, or Firm*—William D. Herrick

[57] ABSTRACT

Improved cover garment is disclosed providing an inner garment access option. For applications requiring a high degree of barrierness, openings are not desired, and the garment is used in its original condition. For other applications where it is desired to obtain access to an inner garment, a weakened line is provided adjacent at least one area of the inner garment where access may be desired. By application of stress to the area of the weakened line, the garment material separates providing a hand hole. The material from which the garment is made is preferable a nonwoven fabric containing thermoplastic fibers, and the weakened line is preferably formed by application of heat and pressure. Garments of the invention find applications as cover garments for clean rooms, hospitals and the like.

7 Claims, 4 Drawing Figures

COVER GARMENT WITH INNER GARMENT ACCESS OPTION

BACKGROUND OF THE INVENTION

1. Field of the Invention

The present invention is directed to cover garments intended to be worn over pocket containing inner garments. Such cover garments find wide applications in clean rooms such as laboratories, hospitals, and the like, as well as other environments such as machine shops, garages and manufacturing facilities. They may take a wide variety of forms, such as coveralls, lab coats, aprons, frocks, gowns, and the like hereinafter referred to collectively as "garments". All such may be either made of durable fabrics intended for multiple uses or of low cost materials such as nonwoven fabrics and the like intended for a single use. The present invention is particularly suited for such garments that are disposable and made from nonwoven fabrics containing thermoplastic fibers.

2. Description of the Prior Art

Cover garments are well known, and such garments, if intended for single use, are often made from thermoplastic fiber containing nonwoven fabrics. For cost considerations, many such disposable garments do not include pockets which is a source of inconvenience to the wearer, particularly when the garment is worn for an extended period. Thus the wearer of the prior art gowns has many times been forced to cut openings in a disposable gown to permit access to pockets of his inner garments or incur the expense of using gowns with pockets for the situations where pockets are desired. On the other hand, many of the more demanding applications for such cover garments require that the garment be essentially free from holes which could pass contamination other than those necessary to don it.

SUMMARY OF THE INVENTION

The present invention is directed to an outer garment adapted to serve both the very demanding applications requiring essentially a barrier as well as those applications where it is appropriate to provide access to pockets of the inner garment. The wearer, thus, has the option in a single garment of working in either environment. In accordance with the invention, this result is obtained by providing a garment, preferably made from a web containing thermoplastic fibers, with a weakened area adjacent a location that would cover at least one inner garment area to which access may be desired such as an inner garment pocket area. This weakened line has sufficient strength to maintain its integrity during use should the use demand barrier properties. On the other hand, by applying some stress, the line readily separates forming a hand hole and convenient access to the inner garment pocket. Thus, this single garment embodiment will serve both the very demanding clean room applications as well as the more conventional coverall applications, both at costs consistent with disposability.

DESCRIPTION OF THE PREFERRED EMBODIMENTS

Figure 1:
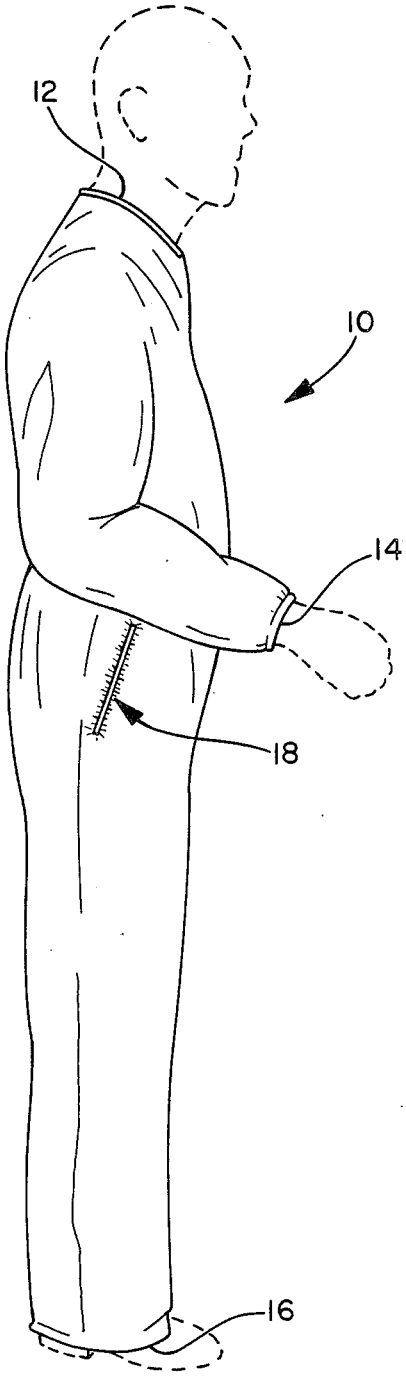
FIG. 1 illustrates in schematic view a cover garment of the present invention incorporating the inner garment entry option feature.
Figure 2:
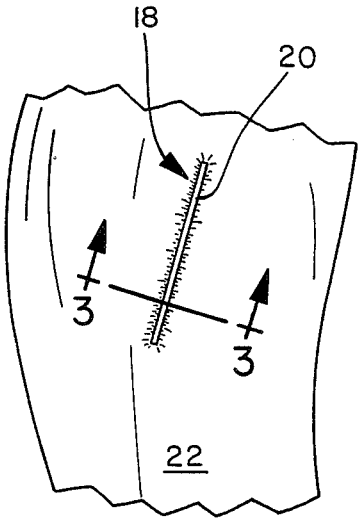
FIG. 2 is an enlarged view of the preferred means for providing the inner garment access option.

As will be recognized by those skilled in the art, the cover garment of the present invention may take a wide variety of apparel forms. While a coverall garment is illustrated, examples of other garments include, without limitation, lab coats, aprons, hospital gowns, and all manner of clean room apparel. In general, it is contemplated for use wherever it is desirable to wear a cover garment over inner, pocket containing apparel and protect either the wearer from the environment or the environment from the wearer. In either case, the outer garment acts as a barrier to transfer of contamination. The need for barrier properties will vary depending upon the particular application. For many clean room applications such as for some hospital uses for example, it will be important that the barrier properties be as complete as possible and that no holes be found in the garment except as may be essential for donning it. On the other hand, for many other applications such as garages, machine shops, and the like, these requirements are less rigid and means for obtaining access to the inner garment through the outer garment are not objectionable and a desired convenience. In accordance with the present invention, a single outer garment having features making it uniquely adaptable to this wide range of applications is provided by presenting an outer garment which is essentially free from holes except those necessary for donning, but which contains means for easily providing access to the inner garment pockets in those applications where it is appropriate.

While the present invention in its broadest concept could be applicable to at least the initial wearing of reusable textile cover garments, it finds its primary application as a feature of disposable cover garments. Because of the nature of the inner garment access option, once it has been opened for a particular garment, the option no longer exists. For a reusable garment, once the inner garment access opening has been made, the future uses of the garment will be limited to those for which the opening is acceptable. Therefore, the present invention is particularly suited for disposable garments which will have single or limited use so that each time a garment is worn the option will be available.

The base material for the manufacture of the cover garment of the present invention may be selected from a wide variety of fibrous webs considering both the cost and intended use of the garment. For most disposable applications, however, nonwoven webs containing thermoplastic fibers are preferred. Many known processes are available for forming such nonwoven webs, including, for example, a spunbonded process as described in U.S. Pat. No. 4,340,563 to Appel and Mormon entitled "Apparatus for Forming Nonwoven Webs" dated July 20, 1982. For improved barrier properties, laminates of such webs with meltblown webs may be used, including those described in U. S. Pat. No. 4,041,203 to Brock and Meitner, dated Aug. 9, 1977. Both of these patents are incorporated herein by reference in their entirety. Webs formed from mixtures of thermoplastic fibers with other fibers may be used, but for purposes of the preferred means for obtaining the inner garment entry option, the material will contain at least about 15% thermoplastic fibers, preferably about at least 50%. Such thermoplastic fibers may include, by way of example and not limitation, polyolefins such as polypropylene and polyethylene, polyesters such as polyethylene terephthalate and polyamides such as nylon as well as blends of any of these with thermoplastic or other components.

Turning to FIGS. 1 through 4, the invention will now be described with specific reference to a coverall garment. As shown in FIG. 1, coverall garment 10 generally includes essentially neck to ankle coverage with neck opening 12, wrist opening 14, and ankle opening 16. While shown in side view, it will be understood that corresponding wrist and ankle openings are present on the opposite side as well and the view from the opposite side may be identical. Including reference now also to FIGS. 2 and 3, the inner garment access means 18 comprises an embossed line 20 shown somewhat exaggerated for detail. The length of line 20 will be sufficient to permit the wearer's hand to pass through when opened, but will otherwise be kept to a minimum to avoid exaggerating the resulting opening. As shown, the embossed line 20 weakens fabric 22 in the embossed line area as indicated by the substantially reduced thickness at line 20. While a continuous embossment is shown for line 20, other means for weakening the line area may be employed such as perforations. However, the continuous line of embossment is preferred since it minimizes openings in fabric 22 should the application demand a complete barrier without the pocket opening.

Figure 4:
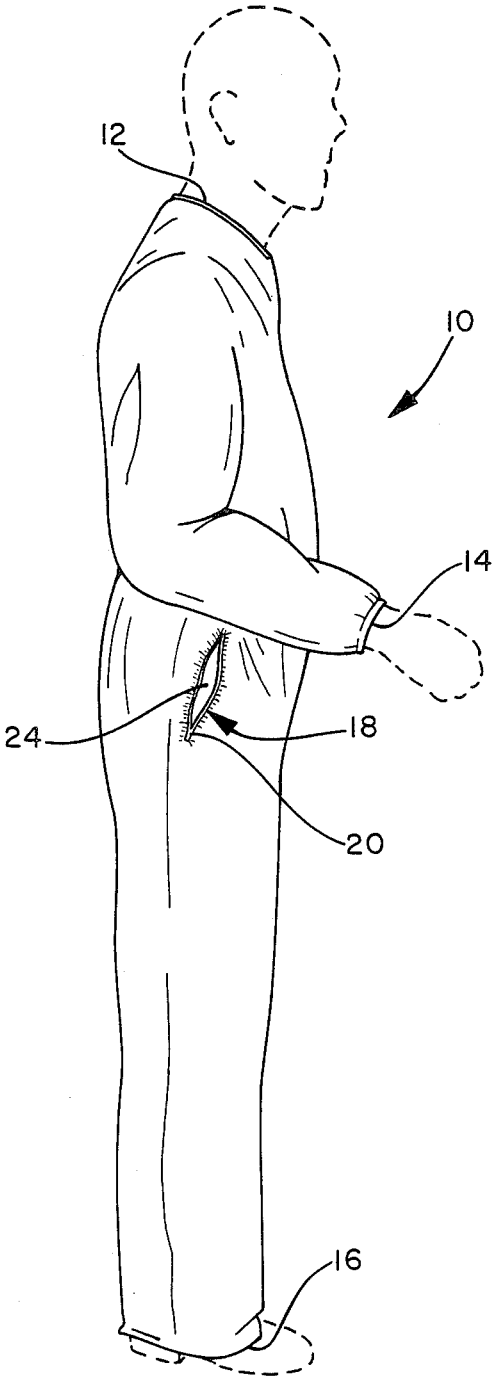
FIG. 4 is a view like that of FIG. 1, showing the garment with the inner garment access feature in its opened condition.
Figure 3:
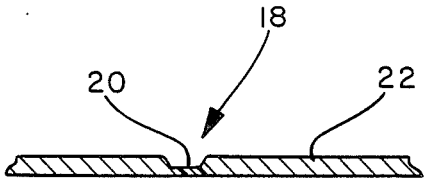
FIG. 3 is a cross-section taken along lines 3—3 of FIG. 2, further illustrating the preferred means for obtaining the weakened line.

Turning to FIG. 4, garment 10 is shown with the inner garment access option exercised and the embossed line 20 opened to provide access aperture 24 which will permit the wearer's hand to pass into the inner garment pockets. While the embodiment illustrated shows access to the side pants pocket, it will be recognized that the present invention is equally adaptable to providing access to hip pants pockets and shirt pockets as well. Should access to other inner garment areas be desired, additional alternative weakened lines may be appropriately located.

Means for obtaining the weakened line inner garment access option preferably include the application of heat and pressure, especially through the use of sonic energy. In this manner, the embossed line may be formed either in the base material for garment 10 prior to construction or after the garment has been formed as part of the sewing or bonding operation. By passing the line area of the garment between a sonic bonding horn and an anvil of the desired line shape and application of sonic energy, the line may be formed. In order to maintain the barrier for those cases desired, the line, after embossing, should have a strip tensile strength as measured by Federal Test Method Standard No. 191, Method 5102 (Dec. 31, 1968) of at least about 10 pounds, preferably at least about 12 pounds. However, the tensile strength is preferably not greatly in excess of this range particularly above about 20 pounds since opening then would be of increased difficulty. If desired, the embossment may be formed by other means such as a patterned calendar roll or by perforating, although, for the reasons above stated, perforation is not the preferred means. Each of these means may be adapted to continuous operation in the garment forming process or may be performed as an additional step.

In use, the garment on the wearer presents the opportunity to maintain it in its initial condition as a substantially complete barrier for contamination free application or upon applying stress to the weakened area will open in that area providing access to the inner garment pockets should the wearer desire such access. Thus, in accordance with the invention, a cover garment of widely varying applications requiring different degrees of barrier properties has been presented that is capable of low cost manufacture consistent with disposability. As a result it is apparent that there has been provided, in accordance with the invention, a cover garment that fully satisfies the objects, aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A cover garment with inner garment access option means comprising, (a) a cover garment adapted to be worn over inner, clothing to which access may be required, said garment providing protection against contamination, and (b) means in said cover garment for forming hand holes in said cover garment adjacent at least one area of said inner garment to which access may be desired, said means comprising a weakened line of dimensions to allow the wearer's hand to pass through when opened, whereby the wearer may have the option of either maintaining the garment substantially free from access openings or, by applying stress to the weakened line, providing access to said inner garment.

2. The cover garment of claim 1 wherein at least one of said weakened lines is located adjacent an area where inner garment pockets may be located.

3. The cover garment of claim 1 wherein said garment is otherwise free from openings except those necessary to don the garment.

4. The cover garment of claims 1, 2 or 3 made from a base material comprising a nonwoven fabric including at least about 15% thermoplastic fibers.

5. The cover garment of claim 4 wherein the tensile strength of the weakened line area is in the range of from about 10 to 20 pounds.

6. The cover garment of claim 4 wherein said weakened line is formed by application of sonic energy.

7. The cover garment of claim 4 made from a base material comprising a nonwoven fabric including at least about 50% thermoplastic fibers.

* * * * *